United States Patent [19]

Quéré et al.

[11] 4,176,446

[45] Dec. 4, 1979

[54] ASSEMBLY PROCESS OF ELECTRODES IN AN INSULATING MATERIAL

[75] Inventors: Eugène M. Quéré, Brunoy; Pierre M. Le Rolland, Le Plessis Trevise, both of France

[73] Assignee: ITT Industries, Inc., New York, N.Y.

[21] Appl. No.: 876,770

[22] Filed: Feb. 10, 1978

[30] Foreign Application Priority Data

Mar. 30, 1977 [FR] France ..... 77 09494

[51] Int. Cl.[2] ..... H01H 11/06

[52] U.S. Cl. ..... 29/622; 29/521

[58] Field of Search ..... 29/630 R, 631, 521, 29/525, 746, 761, 798, 591, 622

[56] References Cited

U.S. PATENT DOCUMENTS 1,163,784 12/1915 Skinner ..... 29/521

3,324,544 6/1967 Haller ..... 29/521

3,432,925 3/1969 Woolley ..... 29/630

*Primary Examiner*—Michael J. Keenan

*Attorney, Agent, or Firm*—John T. O'Halloran; Jeffrey P. Morris

[57] ABSTRACT

A process of anchoring and assembly of contact springs of miniature relays provided for mounting on printed circuit boards is disclosed. Each electrode, associated with a contact spring, extends the latter outside the relay and includes a fixing lug provided with semicircular cuts determining two fixing fingers. Each electrode is inserted into a slot of the relay support wall and is submitted to a force which causes the semicircular cuts to be deformed. This results in both fingers away from each other, penetrating the relay support insulating material and housing therein by deforming this material within said cuts.

6 Claims, 10 Drawing Figures

ASSEMBLY PROCESS OF ELECTRODES IN AN INSULATING MATERIAL

BACKGROUND OF THE INVENTION

The present invention concerns an assembly process of electrodes in an insulating material and, more particularly, a self-clamping process for electrodes used in miniature relays.

The development of installations equipped with electronic equipment mounted on printed circuit boards as well as the need of electromechanical relays in the same installations have led to a new catagory of miniature relays which may be mounted on such boards without by this modifying the assembly pitch of the boards. One of these relays has been the object of the French patent application No. 77 03768 filed on Feb. 10, 1977 in the name of CGCT and entitled "Relais miniaturisé embrochable" (Pluggable miniature relay).

There are two different ways of mounting this relay on a printed circuit board: either directly or after plugging-in on a socket connector itself mounted on the board used as connection support. Due to both assembly versions, it is not possible to use in all cases the same parts to ensure the relay external electric connection. Moreover, instead of having, e.g., different contact springs, not only according to the contact combination but according to the mode of assembly on the printed circuit board, the contact springs are standardized and there have been provided two types of intermediate parts—or electrodes—which are associated, on the one hand, to the contact springs and present, on the other hand, a configuration enabling the direct connection to the printed circuit board or the plugging-in on the socket connector.

But if the contact springs may be, for example, soldered to their respective electrodes—these electrodes having the configuration compatible with the mode of assembly onto the printed circuit board—nevertheless, the problem raised by the anchoring of the assemblies constituted by the electrodes and the contact springs exists. This anchoring is made on the relay support itself and it is generally tricky due to the miniaturization of the parts concerned, to the use of intermediate fixing (anchoring) means and to the need of a rigid anchoring means which can be automatized.

SUMMARY OF THE INVENTION

The object of the present invention is to meet these requirements by proposing an electrode which, when positioned in the housing intended for it in the relay support, is deformed under the action of the introduction force and anchors by itself in the insulating material which it cooperates with.

For this purpose, the invention provides that the electrode comprises a lug determined by two cuts adjacent to it, said cuts receiving the corresponding projections present in the bottom of the relay support housing and stopping these projections in order to constitute the introduction limit of the electrode within its housing. This lug may be inserted in the space delimited by the two projections of the housing bottom. Being approximately rectangular, it includes a semi-circular cut on each of its three free edges, these three cuts determining between them two fingers. When the electrode is positioned in the housing of the relay support, in a first step, both fingers abut the housing bottom while there exists a clearance between the free end of the housing projections and the bottom of the cuts receiving them. In a second step, the introduction is continued until this clearance no longer exists, that is, until said projections touch the bottom of these cuts. During this second positioning step, both lug fingers move away from each other due to the giving way of the semi-circular cut situated between them resulting from the introduction force and the resistance called into action by the insulating material of the housing bottom. Both fingers then penetrate the insulating material of the housing bottom and of the adjacent projections continuing to be deformed and chasing the projection insulating material towards each of the two other cuts of the lug. The latter is then perfectly anchored in the insulating material.

Other feature objects and advantages of the invention will become apparent from the following description and with reference to the accompanying drawing wherein:

DESCRIPTION OF THE PREFERRED EMBODIMENT

Figure 1:
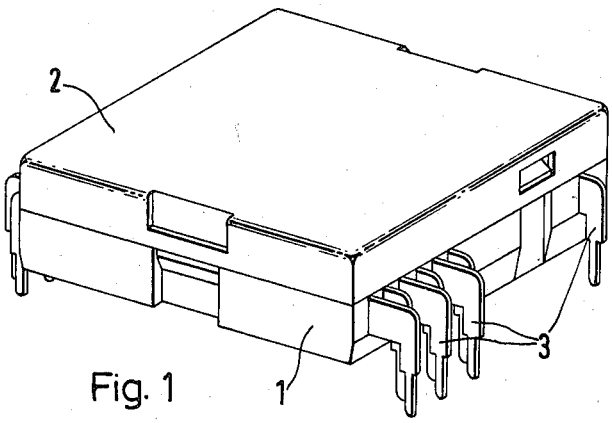
FIG. 1, a perspective view of a miniature relay, with its cover, for a direct connection to a printed circuit board.
Figure 2:
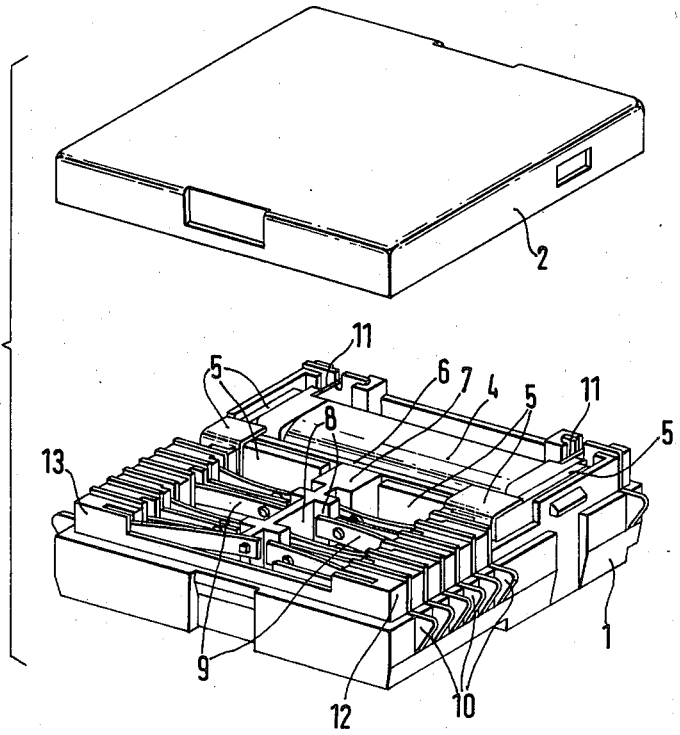
FIG. 2, a perspective view of a pluggable miniature relay with its cover removed.

The description will begin referring first to FIGS. 1 and 2 which illustrate two types of miniature relays intended to be mounted on printed circuit boards such as already mentioned in the above patent application. The miniature relay of FIG. 1 is a relay which is directly mounted on the printed circuit board. Its constituents are placed in a support 1 of plastic material, the protection against external agents, among which dust, being ensured by cover 2. The electrical connection of certain elements to the printed wiring of the board—not shown on the figure—is achieved by means of electrodes 3 whose pins go through the printed circuit board and are soldered on the copper side of the latter.

FIG. 2 corresponds to the pluggable version of the miniature relay, that is, the version in which the relay is not directly mounted on the printed circuit board but is placed on a plug-in socket connector—not shown on the figure—said socket connector being itself soldered onto the board. Except the external connection electrodes, this relay is identical to that of FIG. 1 and includes, in particular, the same support 1 and the same cover 2. However in FIG. 2, cover 2 has been removed and the electromechanical parts placed in this support, that is, the coil 4 and its magnetic circuit made up by the parts of the yoke referenced 5 and the moving armature consisting in place 6. This armature is integral with the guide 7 which operates through its arms 8 two groups of contact springs such as the ones referenced 9. It is to be noted that these contact springs 9 are identical in either mounting version of the relay represented by FIG. 1 and 2. However, in the pluggable version of FIG. 2, it can be seen that the external connection of the relay is not carried out through electrodes such as 3 (FIG. 1) but through electrodes 10. Now if the connection electrodes have different shapes, their functions are identical in either mounting version, that is they connect conductors 11 of coil 4 as well as contact springs 9 to the board printed circuit. As a matter of fact, only the part of the electrodes outside the relay differs from one version to the other (FIG. 1 or FIG. 2). But the part inside the relay, the one associated with a contact spring and which houses in a slot of the wall 12 or 13, is identical in either version.

Figure 3:
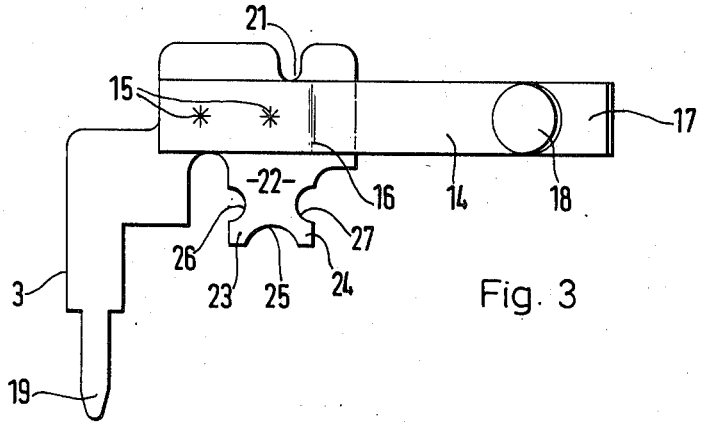
FIG. 3, an assembly constituted by a contact spring and the electrode used by the relay of FIG. 1.
Figure 4:
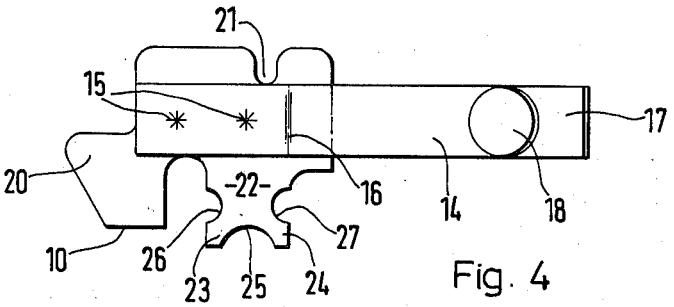
FIG. 4, an assembly constituted by the contact spring and the electrode used by the relay of FIG. 2.
Figure 5:
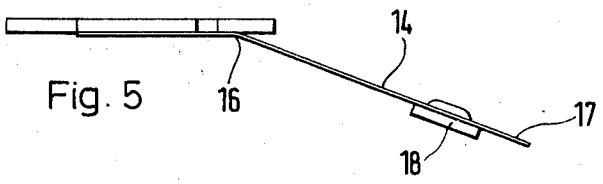
FIGS. 5 and 6, plan views of both complementary "contact spring and electrode" assemblies.
Figure 6:
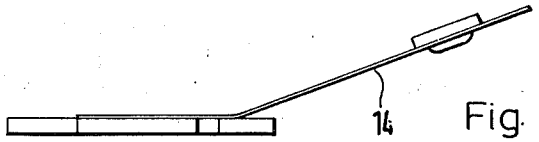

In order to illustrate what has just been described, it will be referred to FIGS. 3, 4 and 5. These figures represent a contact spring 14 associated by two soldering drops 15 to an electrode 3 (FIGS. 3 and 1) or to an electrode 10 (FIGS. 4 and 2). This spring is bent in its part 16 so that it deviates from the corresponding electrode, which gives to its end 17 the necessary contact pressure. This end presents a contact stud 18 associated with contact spring 14 by any appropriate fixing means. FIG. 6 is in all respects similar to FIG. 5 except that the contact spring 14 is soldered on the other face of the electrode. Both contact spring-electrode assemblies are thus complementary and enable the change-over contact combinations such as represented in FIG. 2.

Figure 7:
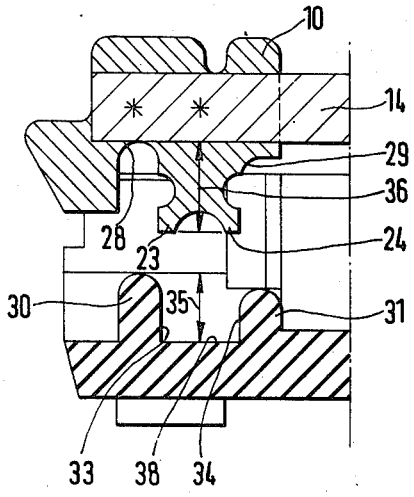
FIG. 7, a sectional view of the elements concerned at the begining of the introduction of the electrode in its housing.
Figure 8:
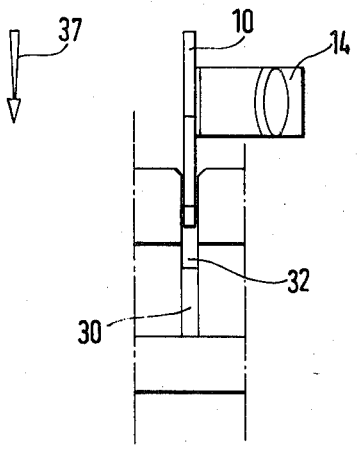
FIG. 8, a profile view of FIG. 7.

However, reverting to FIGS. 3 and 4, except the pin 19 (FIG. 3) and the part 20 (FIG. 4) which ensure the electrical connection of their respective electrodes 3 and 10, it is to be noted that the rest of these electrodes is strictly identical. Indeed, the upper part—with respect to FIGS. 3 and 4—presents a notch 21 whereas the lower part is constituted by a lug 22 whose particular configuration determines two fingers 23 and 24. The notch 21 enables the conductor 11 (FIG. 2) to be soldered when the electrode is used for the electrical connection of the relay coil. The fingers 23 and 24 are used as anchors in the insulating material; this function will be later on described with FIGS. 7, 8, 9, and 10. First, it will be noted that these fingers result from semi-circular cuts 25, 26 and 27 (FIGS. 3 and 4) and that other cuts 28 and 29 (FIG. 7) are made in the electrode in relation to the dimensions of projections 30 and 31 so that these projections exactly house in the corresponding cuts 28 and 29. The projections 30 and 31 are made of the insulating material at the bottom of each slot provided in walls 12 and 13 of support 1 (FIG. 2) for housing a contact spring-electrode assembly. In FIG. 8, it can be seen a slot 32 at the bottom of which is the projection 30, the contact spring 14—electrode 10 assembly being at the beginning of its engagement into slot 32. Referring to FIG. 7, it will be also noted that the distance between faces 33 and 34 of projections 30 and 31 corresponds to that between the external edges of fingers 23 and 24 and that the dimension referenced 35 in the slot is inferior to that referenced 36 of the electrode.

Figure 9:
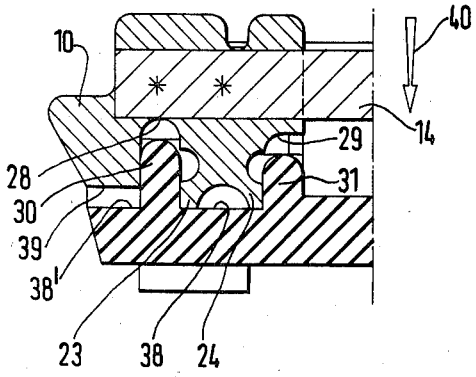
FIG. 9, a sectional view of the elements concerned when the electrode fingers abut the bottom of the insulating support housing.
Figure 10:
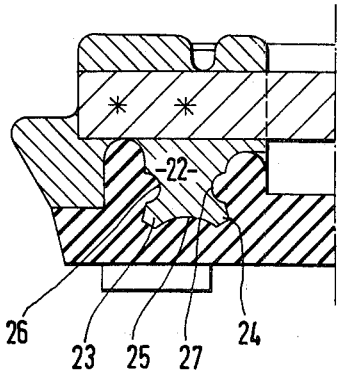
FIG. 10, a sectional view of the elements concerned at the end of the anchoring process of the electrode within its insulating housing.

Under these conditions, if the introduction of the contact spring 14—electrode 10 assembly into the slot 32 continues by exerting a force in the direction of arrow 37, it can be seen that fingers 23 and 24 slide faces along 33 and 34 whereas the projection 30 progressively engages the cut 28 of the electrode until fingers 23 and 24 abut the bottom 38 of the slot. FIG. 9 illustrates this situation and it will be noted that if fingers 23 and 24 abut the bottom 38, it remains the same dimensioned clearance between, on the one hand, the upper round parts of projections 30 and 31 and the bottom of cuts 28 and 29, and on the other, hand, between the edge 39 of the electrode and the bottom 38'. The ultimate phase of the positioning of the contact spring 14—electrode 10 assembly consists in continuing to exert a force in the direction of arrow 40 until these upper round parts of projections 30 and 31 abut the bottom of cuts 28 and 29 and the edge 39 the bottom 38'. However, as fingers 23 and 24 where already touching bottom 38 in the previous introduction phase (FIG. 9), the force (arrow 40) exerted during this ultimate phase causes fingers 23 and 24 to be deformed. In fact, the cut 25 (FIG. 3) is provided so that, under the action of this force, it gives way and enables fingers 23 and 24 to move away from each other. The latter then penetrate faces 33 and 34 of projections 30 and 31 (FIGS. 7 and 9), and thus pushed back insulating material going to house in cuts 26 and 27 (FIG. 3) of the electrode, said cuts being also deformed because of cut 25 giving way and of fingers 23 and 24 moving away from each other consequently (FIG. 3). FIG. 10 then illustrates the situation: the deformed cut 25 has pushed back the bottom 38 of the slot and has penetrated the insulating material, fingers 23 and 24 have done the same with projections 30 and 31 whereas cuts 26 and 27, filled with the insulating material chased by fingers 23 and 24 cooperate to the definitive anchoring of the lug 22 (FIG. 10) of the electrode in its housing.

While the present invention has been described in connection with a preferred embodiment thereof, it is to be understood that additional embodiments, modifications and applications which will become obvious to one skilled in the art are included in the spirit and scope of the invention as set forth in the claims appended hereto.

We claim:

1. A process of assembling electrodes in an insulating material comprising the steps of:

providing an electrode with cuts for cooperating with the configuration of a housing made in the insulating material for receiving a first set of cuts defining a lug in the electrode, said lug comprising a second set of cuts defining between them two fingers, providing a housing in the insulating material having a bottom presenting two projections spaced from each other such that the electrode lug fingers may house therein, the width and height of said projections being determined by the dimensions of the first set of cuts which said projections cooperate with when the electrode is positioned within the housing of the insulating material, and applying a force to introduce the electrode in said housing until said fingers abut the housing bottom, until the free end of the projection abuts the bottom of the first set of cuts, with the electrode fingers then penetrating the insulating material by deformation and deforming the insulating material into the second sets of cuts.

2. A process of assembling electrodes in an insulating material, according to claim 1, wherein the first set of cuts of the electrode is provided with at least one cut whose dimensions correspond to one of the projections of the housing bottom of the insulating material so that it houses therein, said projection being used to center the electrode and as a stop for the electrode when it is introduced in its housing.

3. A process of assembling electrodes in an insulating material according to claim 1 wherein the electrode lug is defined, by the cut receiving the projection of the electrode housing, and by another cut of the first set of cuts, said other cut abutting against another projection of said housing at the end of the introduction of the electrode within its housing.

4. A process of assembling electrodes in an insulating material, according to claim 1 wherein the second set of cuts comprises at least three semi-circular cuts respectively made on the three free edges of the electrode lug, said three cuts defining between them deformable fingers, at least one of said semi-circular cuts being situated between said fingers.

5. A process of assembling electrodes in an insulating material, according to claim 4, wherein the cut situated between the two deformable electrode fingers has provided such dimensions that it gives way when the fingers have reached the bottom of the electrode housing and that the introduction force continues to act upon the electrode, thereby giving way causing both fingers to move away from each other and to penetrate the insulating material of the housing bottom and projections.

6. A process of assembling electrodes in an insulating material, according to claim 4, wherein the cuts other than the cut situated between said deformable fingers have dimensions enabling said cuts to receive the insulating material of the adjacent housing projections deformed by the fingers when the fingers penetrate the insulating material.

* * * * *